US008259028B2

(12) United States Patent
Hills et al.

(10) Patent No.: US 8,259,028 B2
(45) Date of Patent: Sep. 4, 2012

(54) REFLECTOR ANTENNA RADOME ATTACHMENT BAND CLAMP

(75) Inventors: Chris Hills, Fife (GB); Matthew Lewry, Fife (GB); Tracy Donaldson, Fife (GB); Bruce Hughes, Fife (GB)

(73) Assignee: Andrew LLC, Hickory, NC (US)

( * ) Notice: Subject to any disclaimer, the term of this patent is extended or adjusted under 35 U.S.C. 154(b) by 490 days.

(21) Appl. No.: 12/636,068

(22) Filed: Dec. 11, 2009

(65) Prior Publication Data

US 2011/0140983 A1 Jun. 16, 2011

(51) Int. Cl.
*H01Q 1/42* (2006.01)

(52) U.S. Cl. ..... 343/872; 343/775; 343/781 P; 343/781 R; 343/781 CA

(58) Field of Classification Search ..... 343/872, 343/781 P, 781 R, 781 CA, 775, 840, 779
See application file for complete search history.

(56) References Cited

U.S. PATENT DOCUMENTS

| | | | | |
|---|---|---|---|---|
| 2,413,187 | A | 12/1946 | McCurdy et al. | |
| 2,647,212 | A * | 7/1953 | Feldman | 343/777 |
| 3,140,491 | A | 7/1964 | Ashbaugh et al. | |
| 4,410,892 | A | 10/1983 | Knop et al. | |
| 4,581,615 | A | 4/1986 | Levy | |
| 4,876,554 | A | 10/1989 | Tubbs | |
| 4,920,350 | A | 4/1990 | McGuire et al. | |
| 5,298,911 | A | 3/1994 | Li | |
| 6,107,973 | A * | 8/2000 | Knop et al. | 343/781 P |
| 6,137,449 | A | 10/2000 | Kildal | |
| 6,184,840 | B1 * | 2/2001 | Hsin-Loug et al. | 343/781 P |
| 6,339,393 | B1 | 1/2002 | Burnside et al. | |
| 6,522,305 | B2 | 2/2003 | Sharman | |
| 7,138,958 | B2 | 11/2006 | Syed et al. | |
| 7,161,553 | B2 * | 1/2007 | Courtney | 343/872 |
| 2005/0099350 | A1 | 5/2005 | Gothard et al. | |
| 2005/0190116 | A1 | 9/2005 | Syed et al. | |
| 2007/0268198 | A1 | 11/2007 | Marshall et al. | |

FOREIGN PATENT DOCUMENTS

EP 0154240 9/1985

OTHER PUBLICATIONS

O. Bucci, G. Franceschetti, Rim Loaded Reflector Antennas, IEEE Transactions on Antennas and Propagation, vol. AP-28, No. 3, p. 297-305 May 1980.

(Continued)

*Primary Examiner* — Dieu H Duong
(74) *Attorney, Agent, or Firm* — Babcock IP, PLLC

(57) ABSTRACT

A band clamp for coupling a radome to a distal end of a reflector dish for improving the front to back ratio of a reflector antenna, the band clamp provided with an inward projecting proximal lip and an inward projecting distal lip. The distal lip dimensioned with an inner diameter equal to or less than a reflector aperture of the reflector dish. The proximal lip provided with a turnback region dimensioned to engage an outer surface of a signal area of the reflector dish in an interference fit. A width of the band clamp may be dimensioned, for example, between 0.8 and 1.5 wavelengths of an operating frequency.

20 Claims, 19 Drawing Sheets

OTHER PUBLICATIONS

O. Bucci, G. Di Massa, C. Savarese, Control of Reflector Antennas Performance by Rim Loading, IEEE Transactions on Antennas and Propagation, vol. AP-29, No. 5, p. 773-779 Sep. 1981.

O. Bucci, C. Gennarelli, L. Palumbo, Flanged Parabolic Antennas, IEEE Transactions on Antennas and Propagation, vol. AP-30, No. 6, p. 1081-1085 Nov. 1982.

O. Bucci, C. Gennarelli, L. Palumbo, Parabolic Antennas with a Loaded Flange, IEEE Transactions on Antennas and Propagation, vol. AP-33, No. 7, p. 755-762, Jul. 1985.

International Search Report and Written Opinion, International Application serial No. PCT/IB2010/054173, 8 pages, Daejeon, Republic of Korea, Jun. 27, 2011.

* cited by examiner

REFLECTOR ANTENNA RADOME ATTACHMENT BAND CLAMP

BACKGROUND

1. Field of the Invention

This invention relates to microwave reflector antennas. More particularly, the invention relates to a reflector antenna with a radome and reflector dish interconnection band clamp which enhances signal pattern and mechanical interconnection characteristics.

2. Description of Related Art

The open end of a reflector antenna is typically enclosed by a radome coupled to the distal end of the reflector dish. The radome provides environmental protection and improves wind load characteristics of the antenna.

Edges and/or channel paths of the reflector dish, radome and/or interconnection hardware, may diffract or enable spillover of signal energy present in these areas, introducing undesirable backlobes into the reflector antenna signal pattern quantified as the front to back ratio (F/B) of the antenna. The F/B is regulated by international standards, and is specified by for example, the FCC in 47 CFR Ch.1 Part 101.115 in the United States, by ETSI in EN302217-4-1 and EN302217-4-12 in Europe, and by ACMA RALI FX 3 Appendix 11 in Australia.

Prior antenna signal pattern backlobe suppression techniques include adding a backlobe suppression ring to the radome, for example via metalizing of the radome periphery as disclosed in commonly owned U.S. Pat. No. 7,138,958, titled "Reflector Antenna Radome with Backlobe Suppressor Ring and Method of Manufacturing" issued Nov. 21, 2006 to Syed et al, hereby incorporated by reference in its entirety. However, the required metalizing operations may increase manufacturing complexity and/or cost, including elaborate coupling arrangements configured to securely retain the shroud upon the reflector dish without presenting undesired reflection edges, signal leakage paths and/or extending the overall size of the radome. Further, the thin metalized ring layer applied to the periphery of the radome may be fragile, requiring increased care to avoid damage during delivery and/or installation.

Reflectors employing castellated edge geometries to generate constructive interference of the edge diffraction components have also been shown to improve the F/B, for example as disclosed in commonly owned Canada Patent No. CA887303 "Backlobe Reduction in Reflector-Type Antennas" by Holtum et al. Such arrangements increase the overall diameter of the antenna, which may complicate radome attachment, packaging and installation.

The addition of a shroud to a reflector antenna improves the signal pattern generally as a function of the shroud length, but also similarly introduces significant costs as the increasing length of the shroud also increases wind loading of the reflector antenna, requiring a corresponding increase in the antenna and antenna support structure strength. Further, an interconnection between the shroud and a radome may introduce significant F/B degradation.

A conventional band clamp 1 applied to retain a radome 3 upon the reflector dish 7 or shroud may introduce diffraction edges and/or signal leakage paths, for example as shown in FIG. 1. Metal taping, RF gaskets or the like may be applied to reduce F/B degradation resulting from band clamp use. However, these materials and procedures increase manufacturing costs and/or installation complexity and may be of limited long-term reliability.

Competition in the reflector antenna market has focused attention on improving electrical performance and minimization of overall manufacturing, inventory, distribution, installation and maintenance costs. Therefore, it is an object of the invention to provide a reflector antenna that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
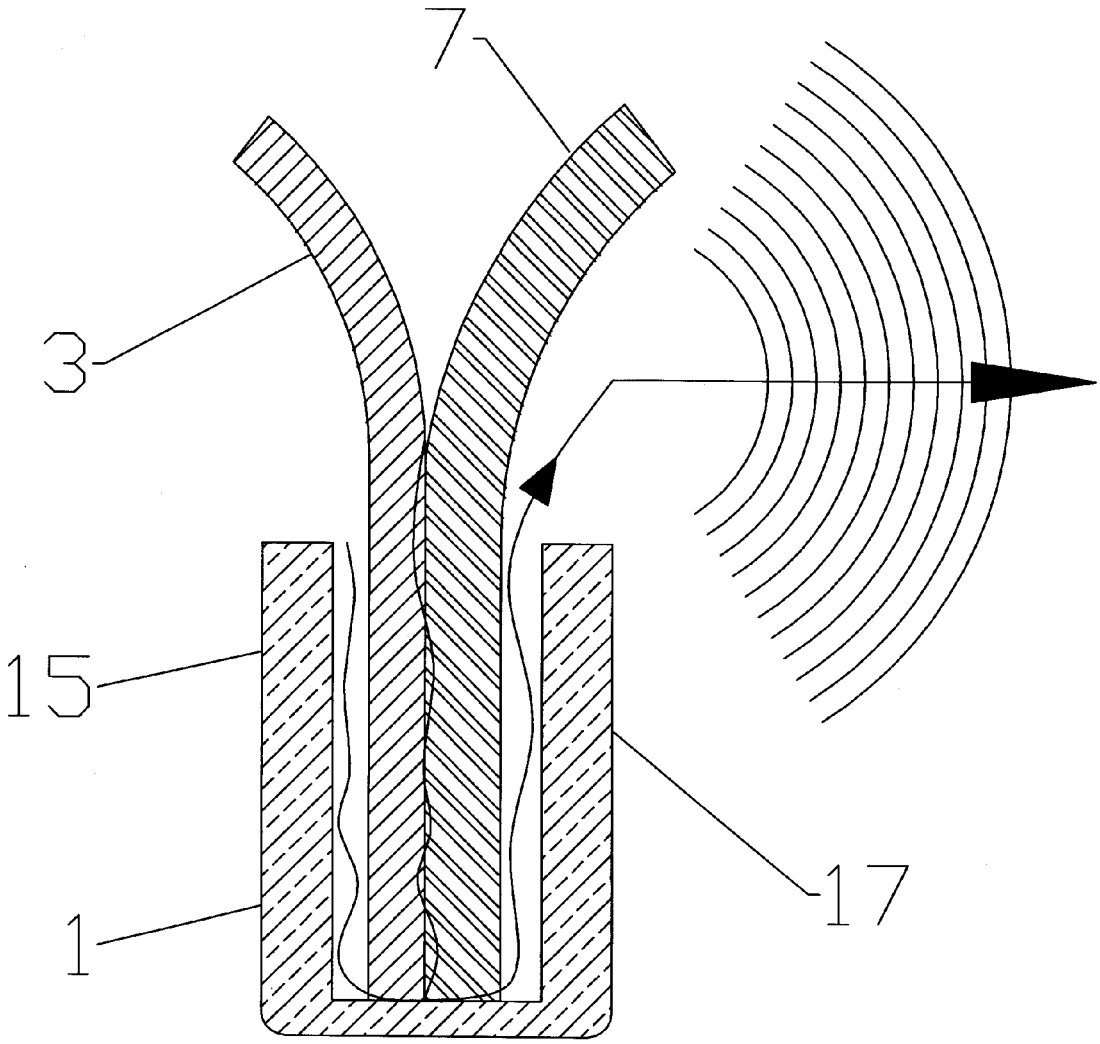
Fig. 1 Prior Art
FIG. 1 is a schematic enlarged cut-away side view of a conventional prior art band clamp radome and reflector dish interconnection, demonstrating an RF signal leakage path.
Figure 2:
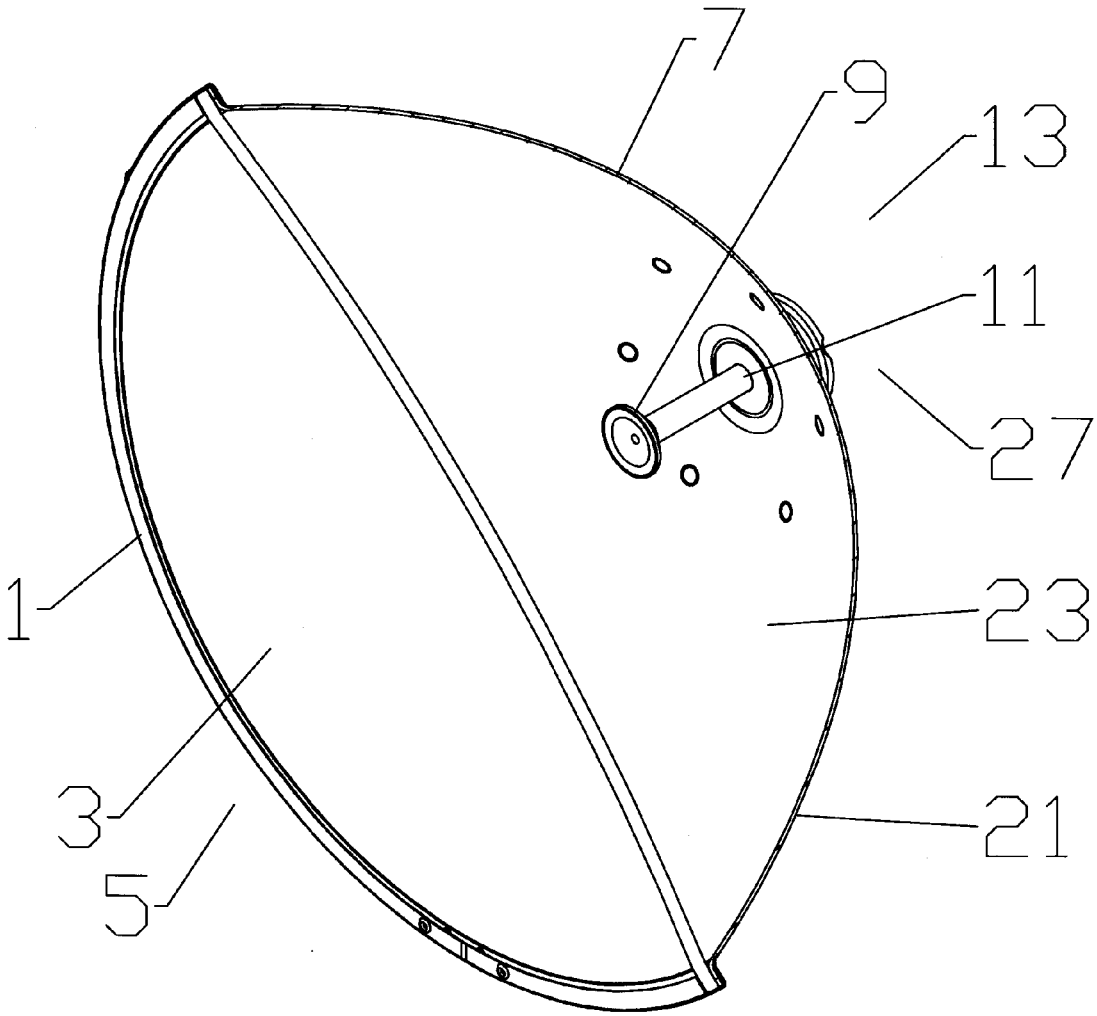
FIG. 2 is a schematic isometric cut-away view of a reflector antenna with radome to reflector dish band clamp interconnection.
Figure 3:
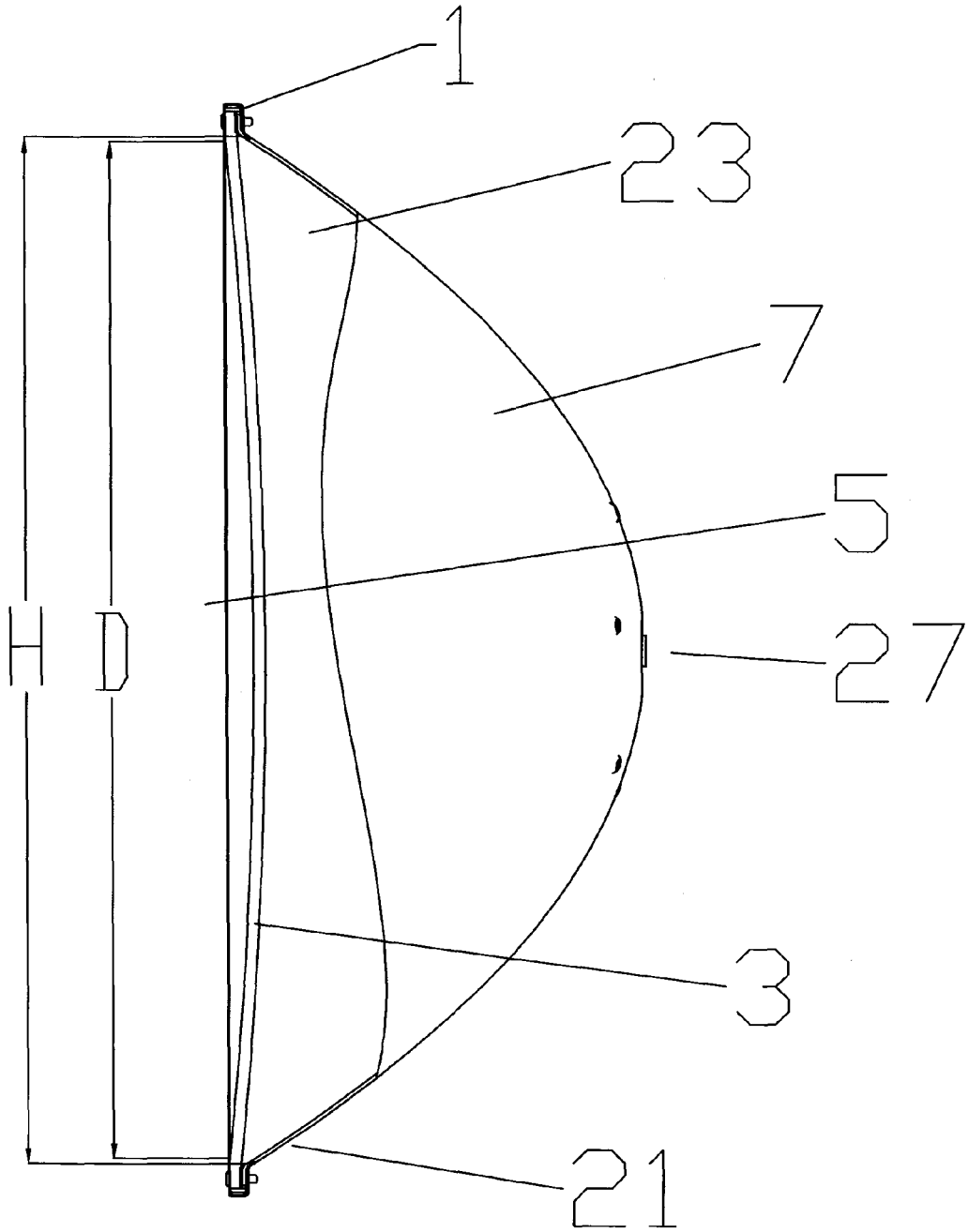
FIG. 3 is a schematic partial cut-away side view of a radome to reflector dish band clamp interconnection.
Figure 4:
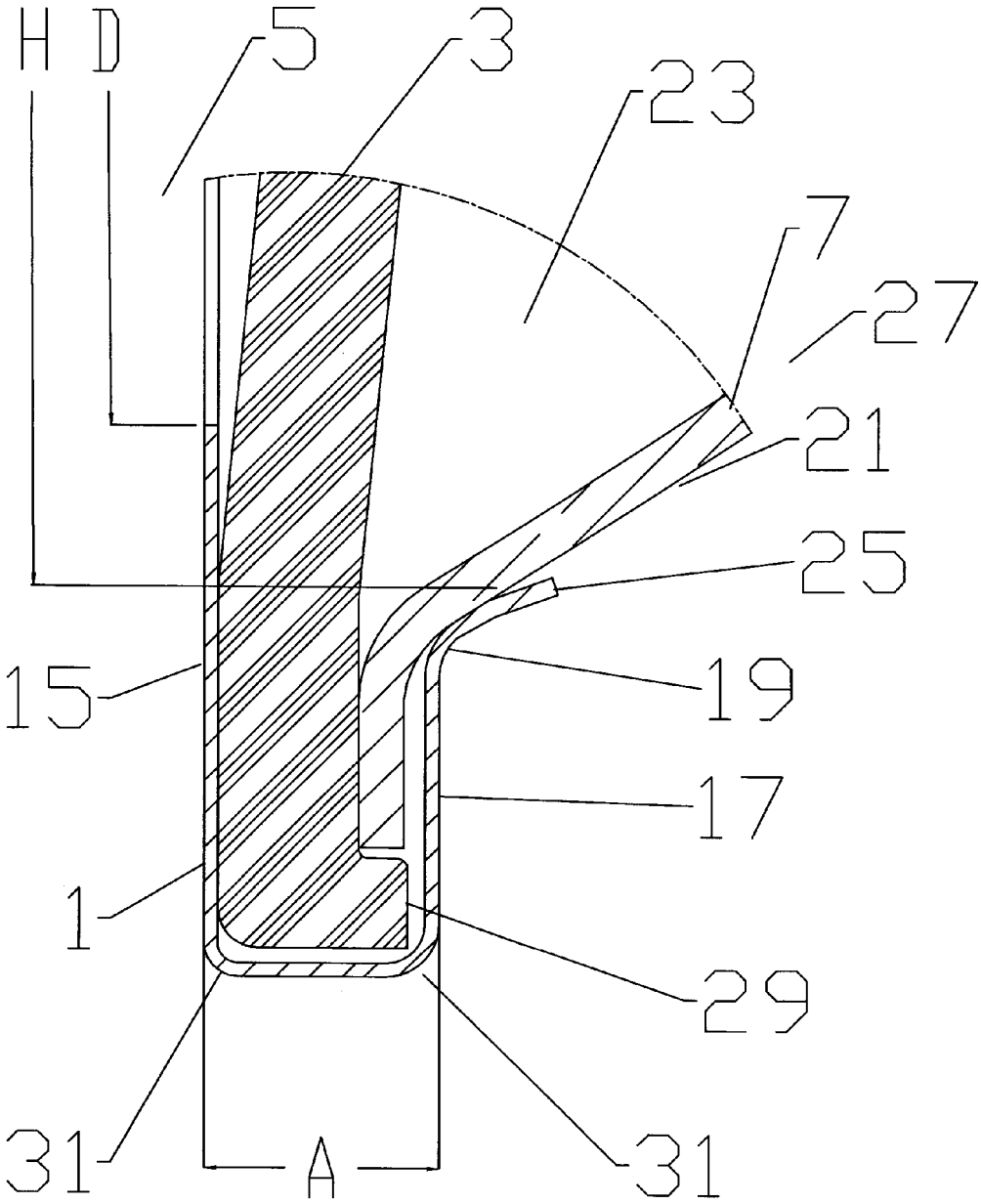
FIG. 4 is an enlarged cut-away side view of a first exemplary radome to reflector dish band clamp interconnection.

As shown in FIGS. 2 and 3, a band clamp 1 is generally operative to retain a radome 3 upon the open distal end 5 of a reflector dish 7, creating an environmental seal that protects the reflector dish 7, subreflector 9 and/or feed 11 of a reflector antenna 13 from environmental fouling. In a first exemplary embodiment, best shown in FIG. 4, the band clamp 1 is provided with inward facing distal and proximal lips 15, 17. A turnback region 19 of the proximal lip 17 is dimensioned to engage the outer surface 21 of the signal area 23 of the reflector dish 7. The turnback region 19 may be applied, for example, as an outward bend prior to the inward end 25 of the proximal lip 17.

As the band clamp 1 is tightened during interconnection of the radome 3 and the reflector dish 7, the diameter of the band clamp 1 is progressively reduced, driving the turnback region 19 against the convex outer surface 21 of the signal area 23 of the reflector dish 7, into a uniform circumferential interference fit. As the band clamp 1 is further tightened, the turnback region 19 slides progressively inward along the outer surface 21 of the signal area 23 of the reflector dish 7 toward the reflector dish proximal end 27. Thereby, the distal lip 15 of the band clamp 1 also moves towards the reflector dish proximal end 27, securely clamping the radome 3 against the distal end 5 of the reflector dish 7. Because the interference fit between the turnback region 19 and the outer surface 21 of the reflector dish 7 is circumferentially uniform, any RF leakage between these surfaces is reduced.

Although it is possible to apply extended flanges to the reflector dish 7 and/or radome 3, these would increase the overall size of the reflector antenna 1, which may negatively impact wind loading, material requirements, inventory and transport packaging requirements. Therefore, flanges of a reduced size, dimensioned to provide secure mechanical interconnection, may be applied. The radome 3 may be provided with a greater diameter than the reflector dish 7, an annular lip 29 of the radome 3 periphery mating with an outer diameter of the distal end 5 of the reflector dish 7, keying the radome 3 coaxial with the reflector dish 7 and providing surface area for spacing the band clamp 1 from the signal area 23 of the reflector dish 7.

Figure 5:
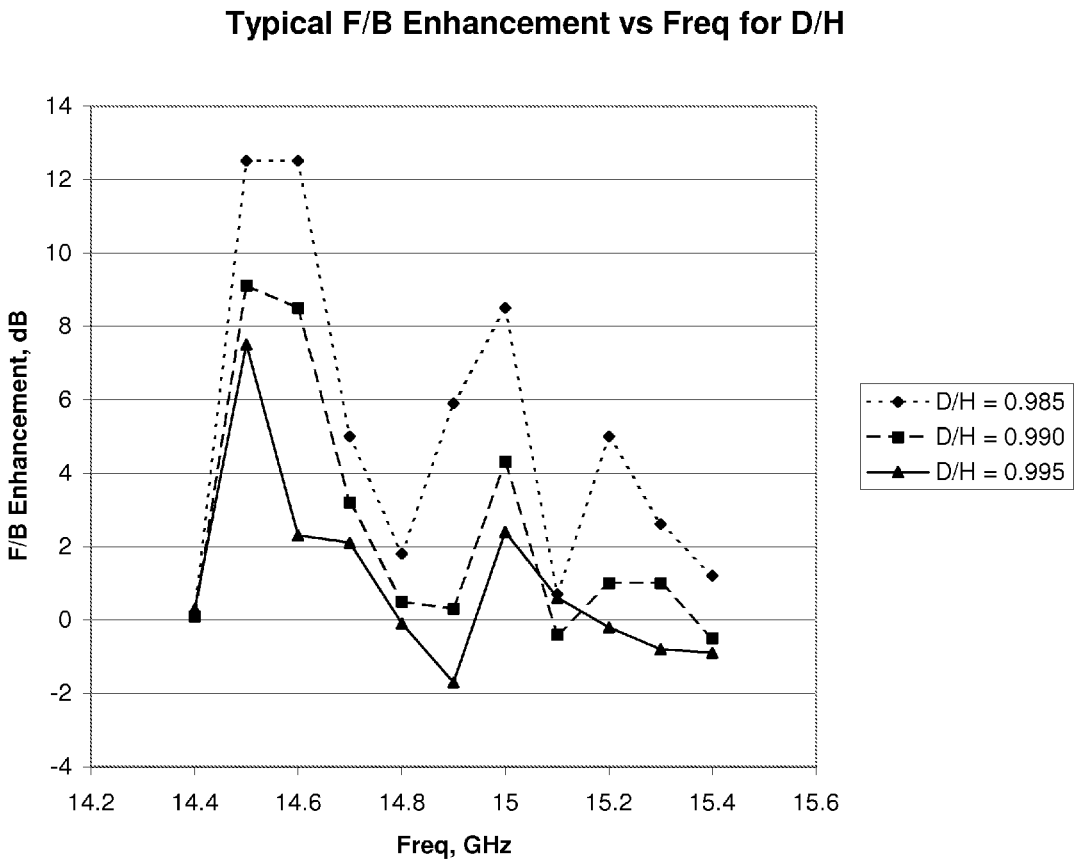
FIG. 5 is a graph illustrating a range of exemplary band clamp distal lip inner diameter to reflector dish aperture ratios and their effect upon corresponding reflector antenna F/B over a range of operating frequencies.

The flanges may be dimensioned and the band clamp 1 similarly dimensioned such that the distal lip 15 of the band clamp 1 is even with or extends slightly inward of a reflector aperture H, defined as the largest diameter of the reflector dish 7 surface upon which signal energy is distributed by the subreflector 9, to form a band clamp inner diameter D. To minimize diffraction and/or scatter signal components at the band clamp 1 distal lip 15, the band clamp inner diameter D may be dimensioned with respect to reflector aperture H, resulting in significant F/B enhancement as illustrated in FIG. 5. For reduced F/B in a reflector antenna 13 of minimal overall diameter, a D/H ratio of 0.97-1.0 may be applied.

Figure 6:
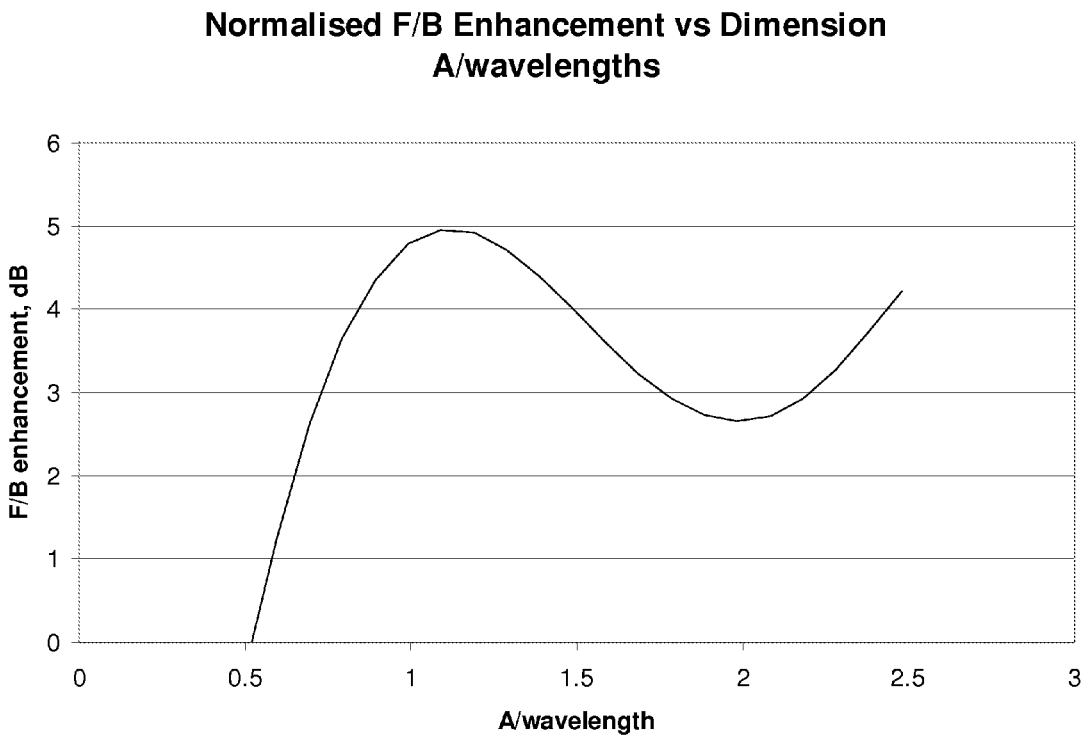
FIG. 6 is a graph illustrating a range of band clamp widths and their effect upon corresponding reflector antenna F/B.

Referring again to FIG. 4, another dimension of the band clamp 1 impacting the F/B is the band clamp 1 width "A" which determines the distance between band clamp 1 outer corner(s) 31 acting as diffraction/scatter surfaces. As shown in FIG. 6, normalized F/B is improved when the width "A" is between 0.8 and 1.5 wavelengths of the operating frequency, which can be operative to generate mutual interference of surface currents traveling along the band clamp 1 outer periphery and/or scatter interference.

Figure 7:
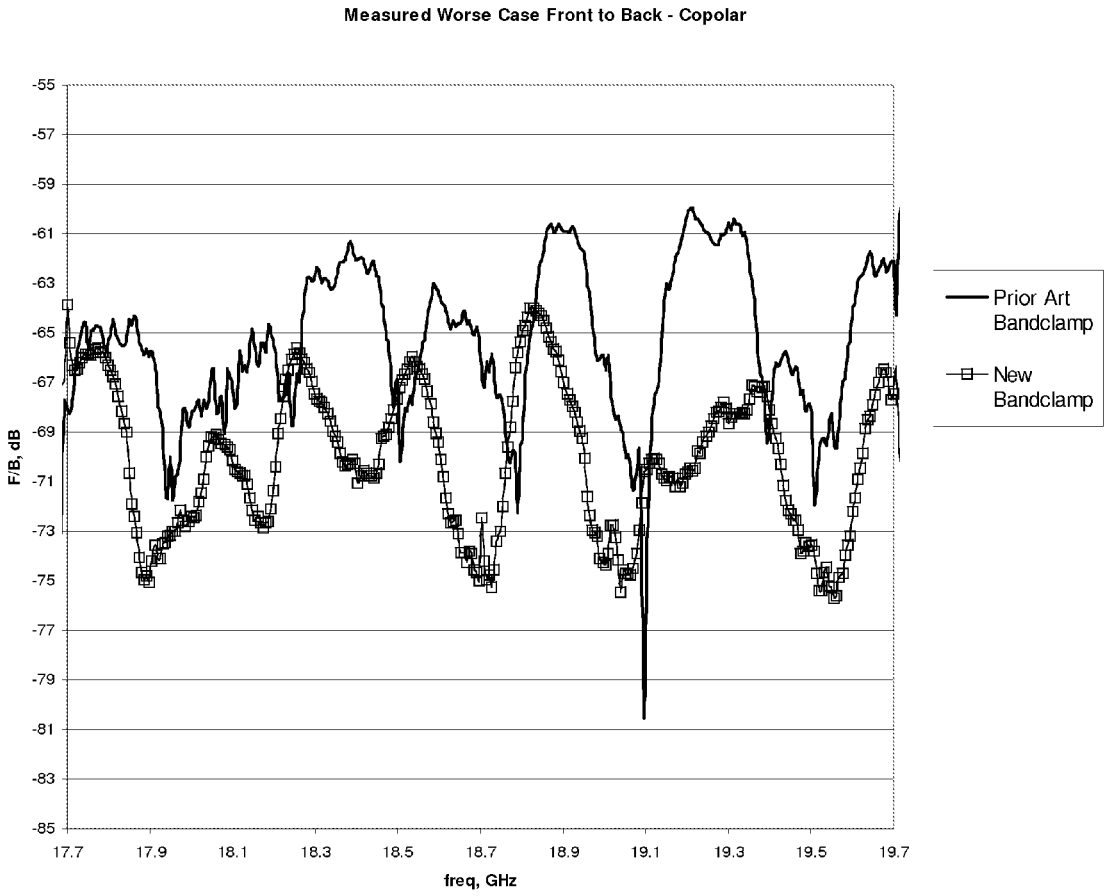
FIG. 7 is a graph comparing measured co-polar F/B performance related to RF signal leakage between conventional band clamp and presently disclosed "new" band clamp configurations.
Figure 8:
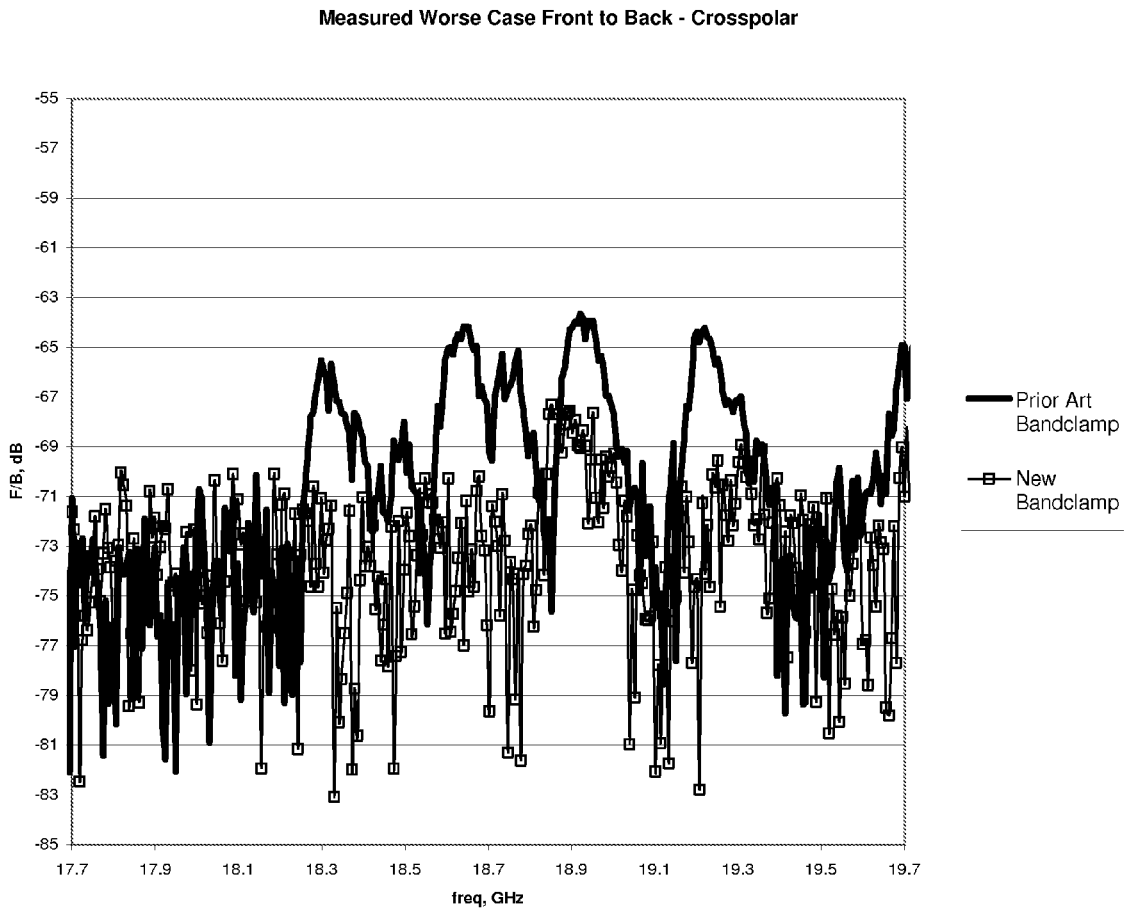
FIG. 8 is a graph comparing measured cross-polar F/B performance related to RF signal leakage between conventional band clamp and presently disclosed "new" band clamp configurations.
Figure 9:
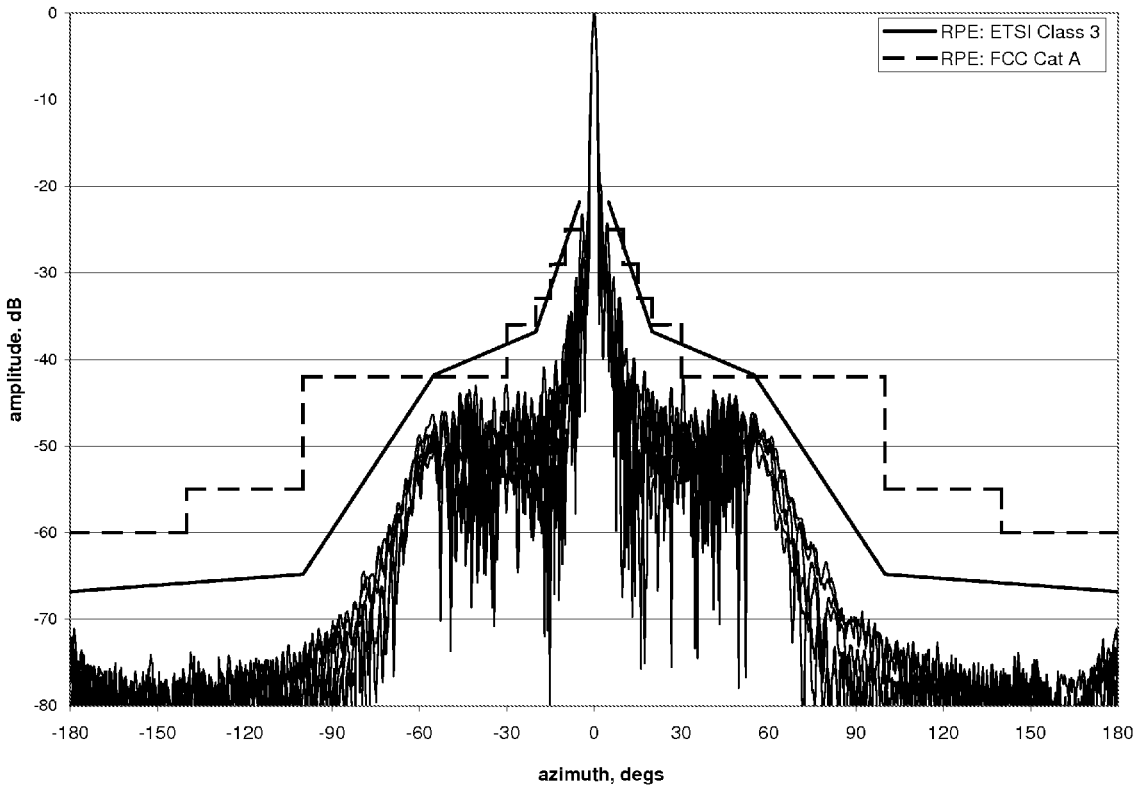
FIG. 9 is a graph of measured co-polar radiation patterns of a 0.6 m reflector antenna with a bandclamp with a 1.1 wavelength width.
Figure 10:
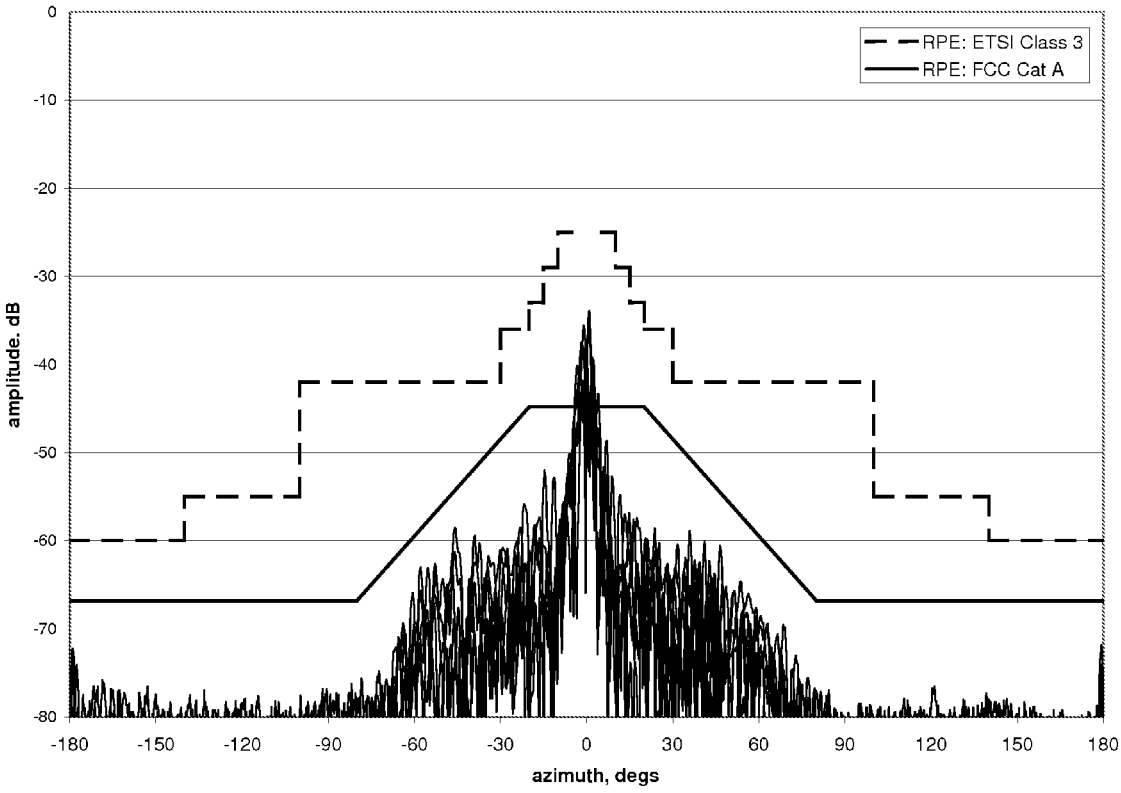
FIG. 10 is a graph of measured cross-polar radiation patterns of a 0.6 m reflector antenna with a bandclamp with a 1.1 wavelength width.

The significant improvement in measured F/B performance in a 0.6 meter reflector antenna configurations for both co-polar and cross-polar responses with a conventional prior art band clamp 1 and the "new" presently disclosed band clamp 1 configuration are illustrated in FIGS. 7 and 8. FIGS. 9 and 10 illustrate measured backlobe levels of co-polar and cross-polar radiation patterns in the 26 GHz band within the regulatory envelopes at greater than 71 dB with the FIG. 4 band clamp 1 configuration, in which the width "A" is equal to 1.1 wavelengths.

Figure 11:
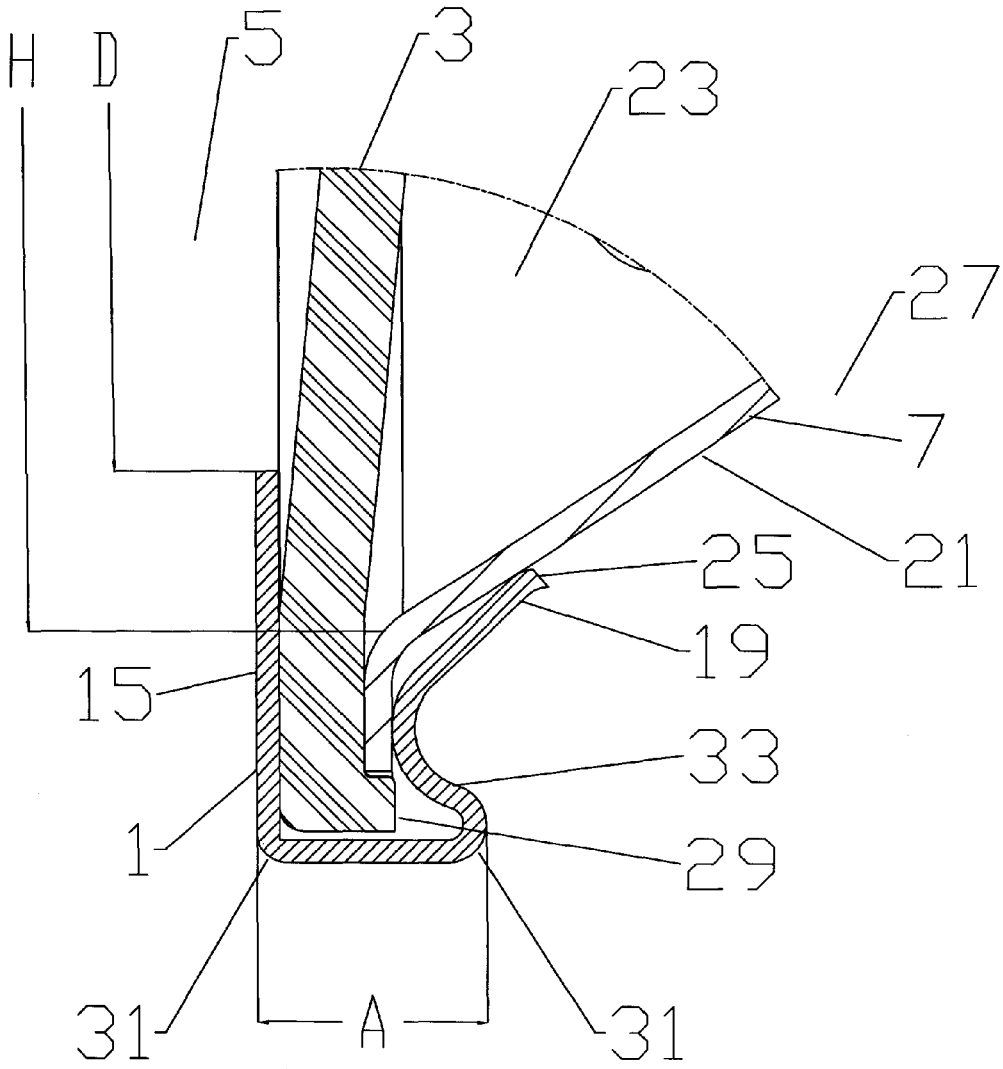
FIG. 11 is an enlarged cut-away side view of a second exemplary radome to reflector dish band clamp interconnection.

One skilled in the art will appreciate that the optimal range of widths "A" may be difficult to achieve for some operating frequencies without incorporating further structure in the radome and/or reflector dish periphery. In a second embodiment, for example as shown in FIG. 11, the width "A" may be increased via the application of a fold 33 in the band clamp from the desired extent of the width "A" back toward the reflector dish 7. The pictured embodiment is simplified for demonstration purposes with respect to extending the width "A" but may similarly be applied with a fold 33 and proximal lip 17 that extends further inward and includes a turnback region 19 contacting the outer surface 21 of the signal area 23 of the reflector dish 7.

Figure 12:
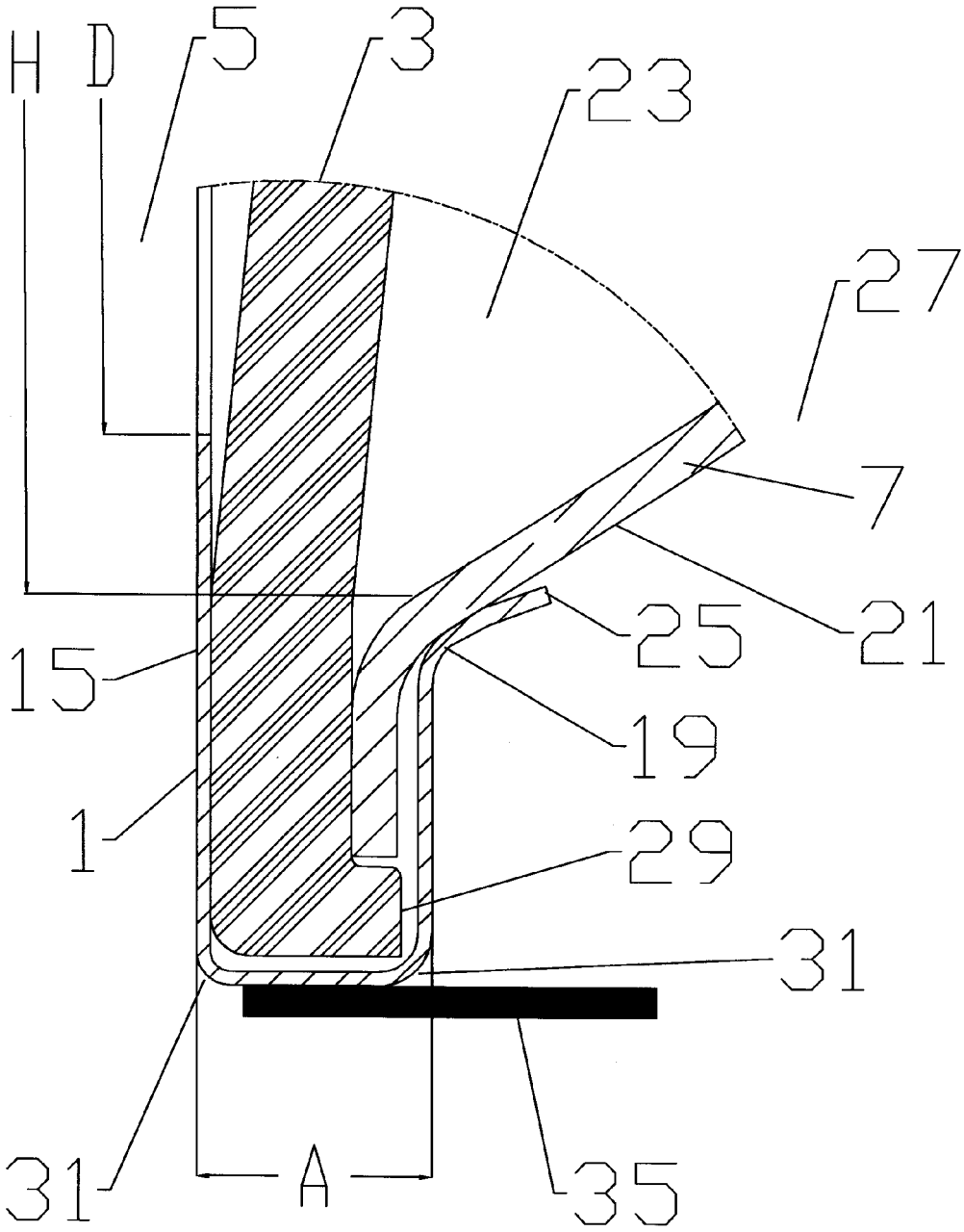
FIG. 12 is an enlarged cut-away side view of a third exemplary radome to reflector dish band clamp interconnection, including a width ring.

In a third embodiment, for example as shown in FIG. 12, an extension of the width "A" may be cost effectively achieved by attaching a further width ring 35 of metallic and/or metal coated material to the band clamp 1 outer diameter. The width ring 35 may be applied with any desired width, cost effectively securely attached by spot welding or fasteners such as screws, rivets or the like.

Figure 13:
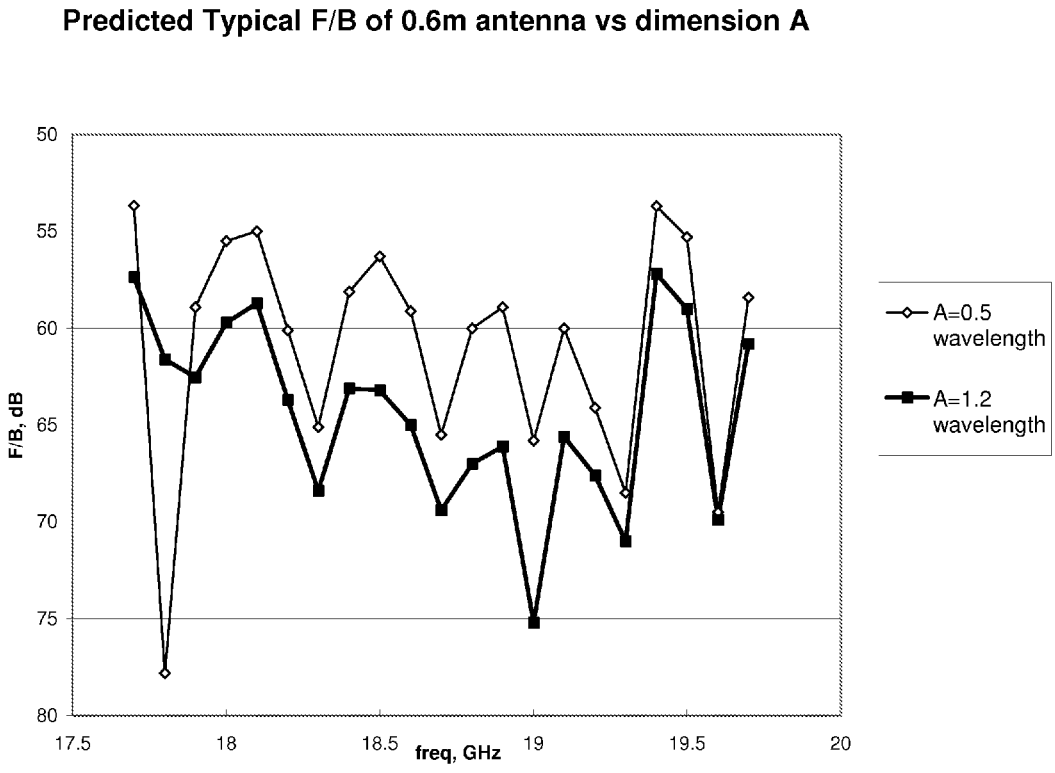
FIG. 13 is a graph comparing predicted F/B enhancement with a band clamp of width of 0.5 and 1.2 wavelengths.
Figure 14:
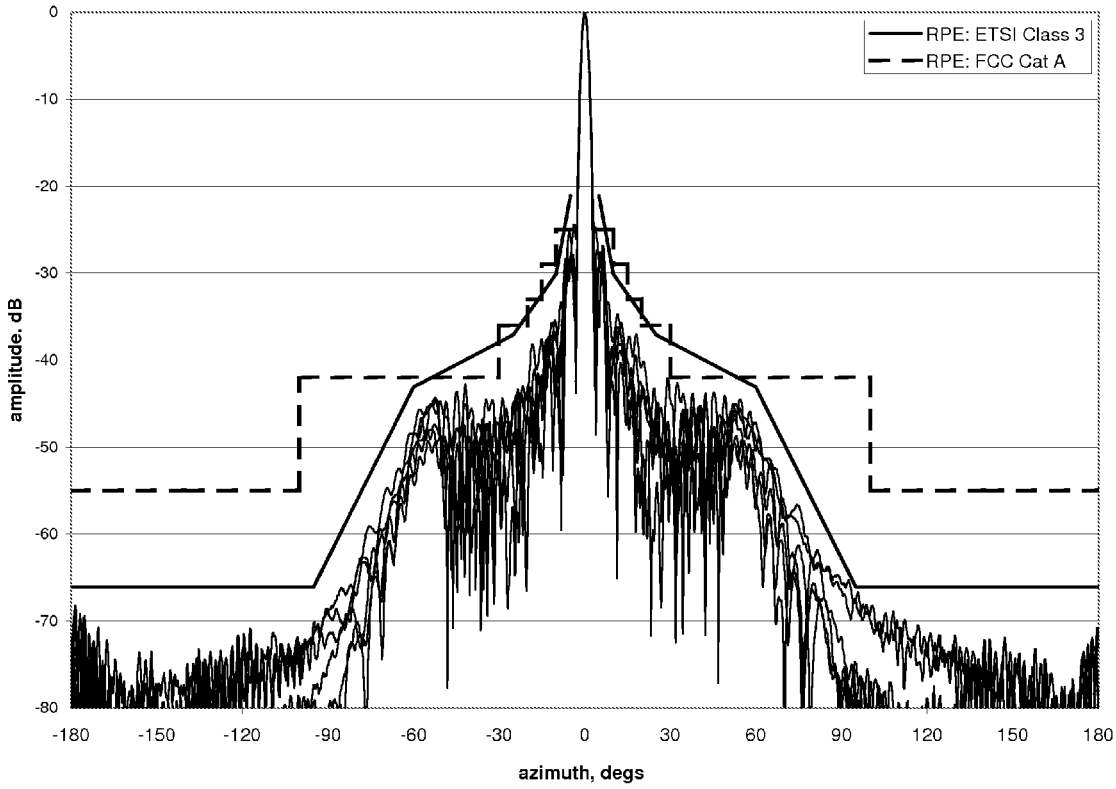
FIG. 14 is a graph of measured co-polar radiation patterns for a reflector antenna with a band clamp with a 0.5 wavelength width.
Figure 15:
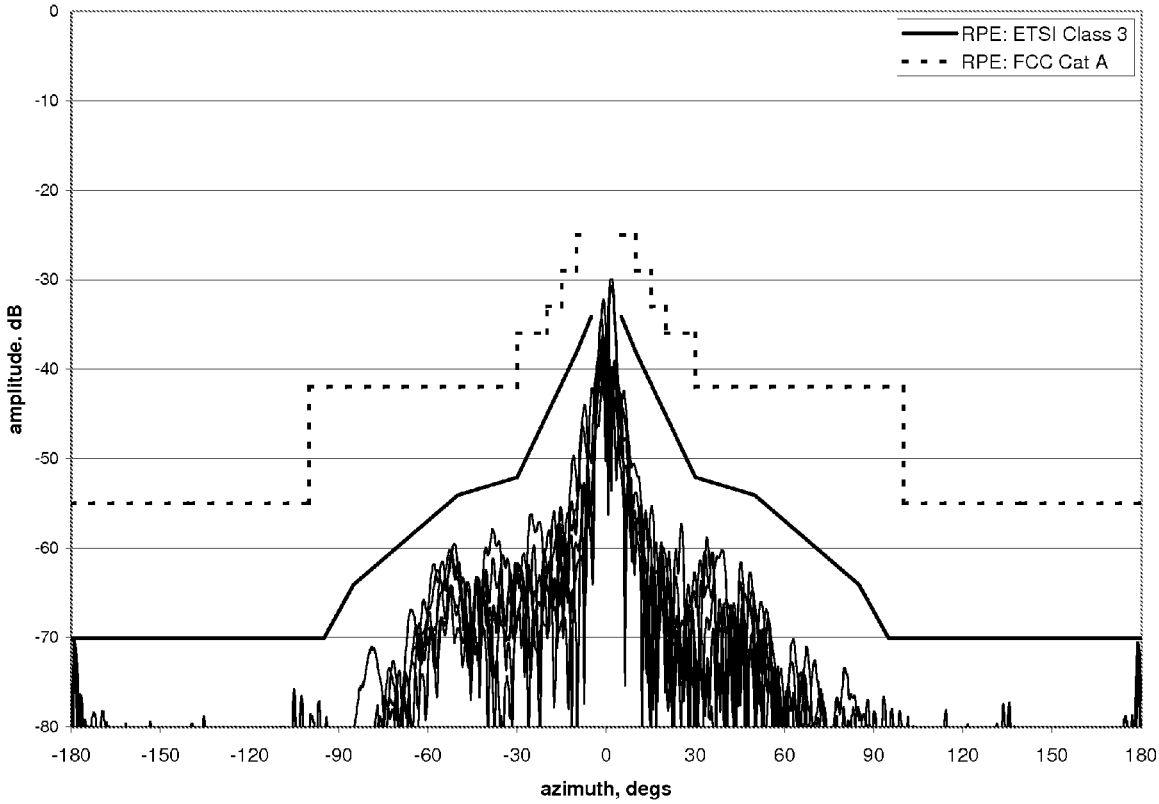
FIG. 15 is a graph of measured cross-polar radiation patterns for a reflector antenna with a band clamp with a 0.5 wavelength width.
Figure 16:
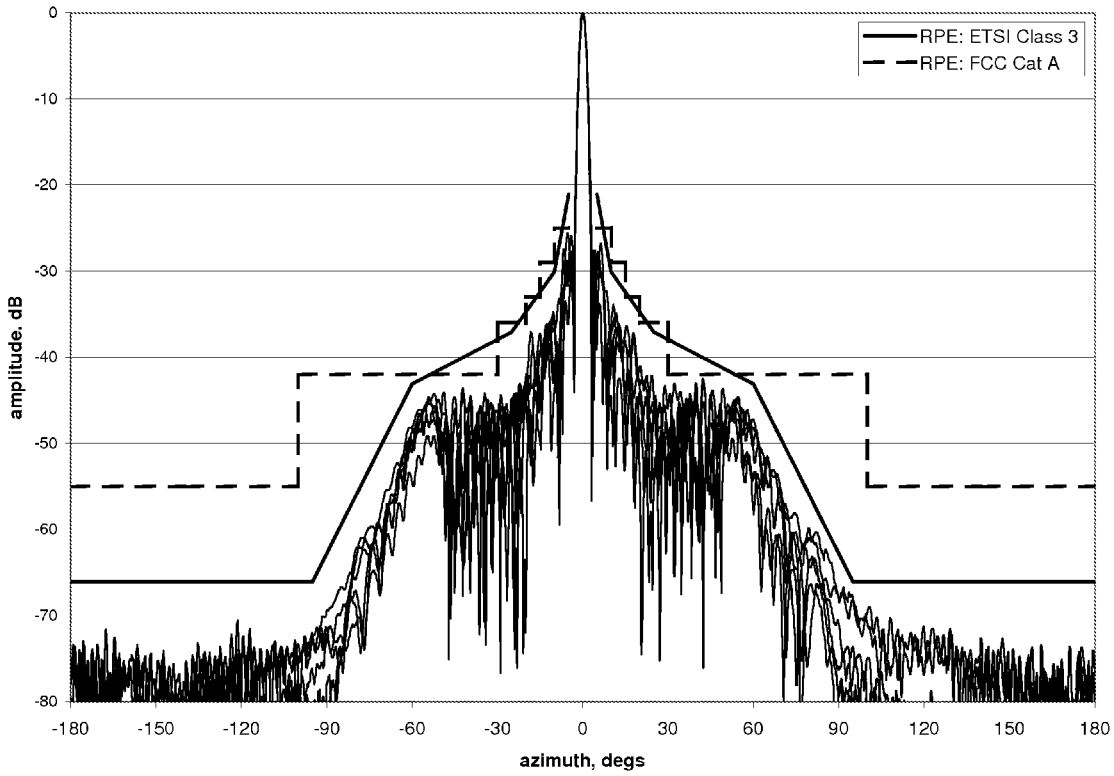
FIG. 16 is a graph of measured co-polar radiation patterns for a reflector antenna with a band clamp with a 1.2 wavelength width.
Figure 17:
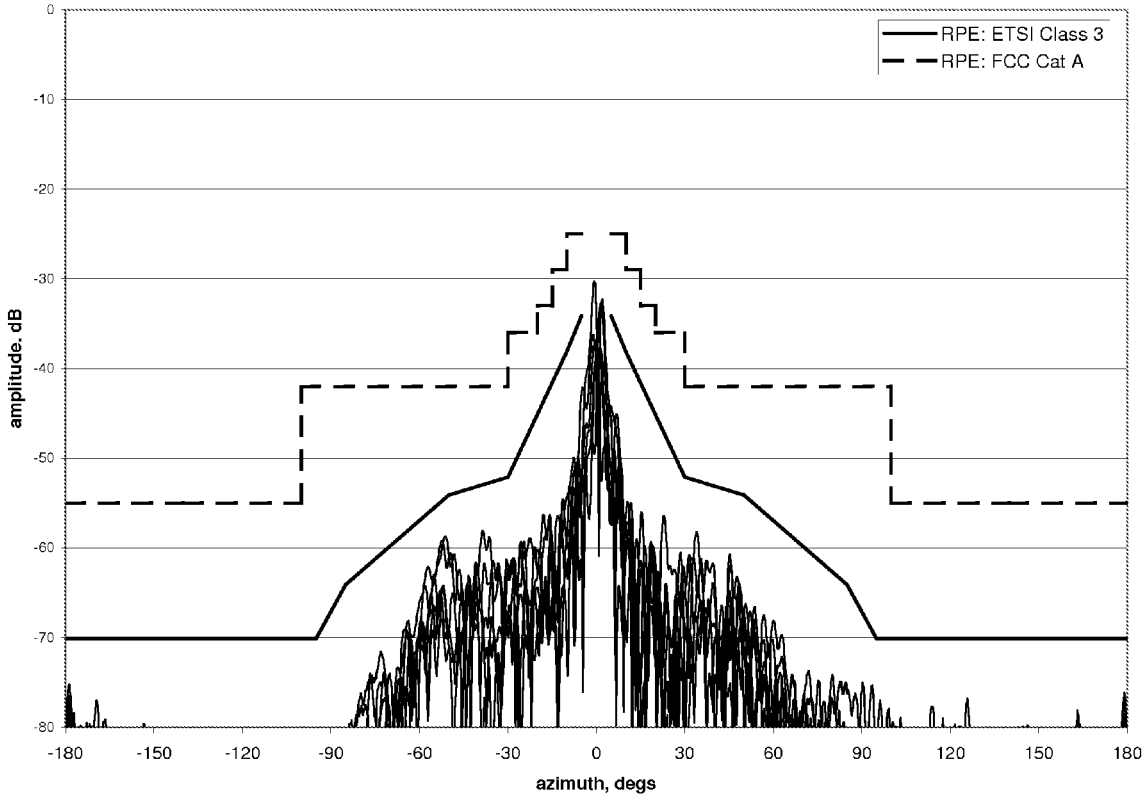
FIG. 17 is a graph of measured cross-polar radiation patterns for a reflector antenna with a band clamp with a 1.2 wavelength width.

FIG. 13 illustrates 18 GHz band RF modeling software predictions of F/B improvement between a width ring 35 width "A" of 0.5 and 1.2 wavelengths. Measured co-polar and cross-polar F/B performance of a FIG. 12 band clamp 1 with width ring 35 of width "A"=0.5 wavelengths is shown in FIGS. 14 and 15. Note the performance meets the regulatory envelope across the entire range, but with no margin. However, as shown in FIGS. 16 and 17, the measured co-polar and cross-polar F/B performance of a FIG. 12 band clamp 1 with width ring 35 of width "A"=1.2 wavelengths is significantly improved and well within the regulatory envelope throughout the entire range.

Figure 18:
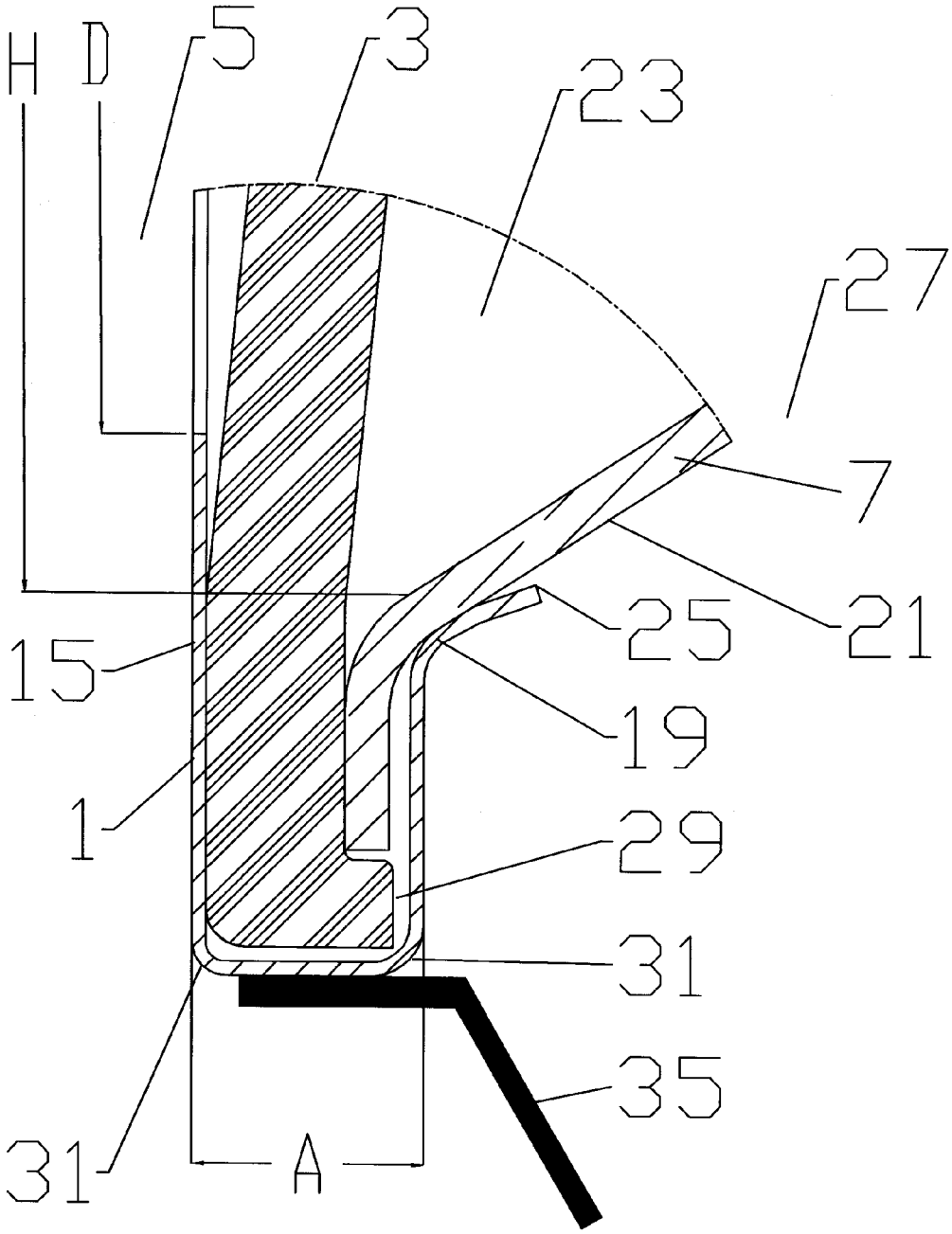
FIG. 18 is an enlarged cut-away side view of a third exemplary radome to reflector dish band clamp interconnection, including a width ring with radial outward bend.
Figure 19:
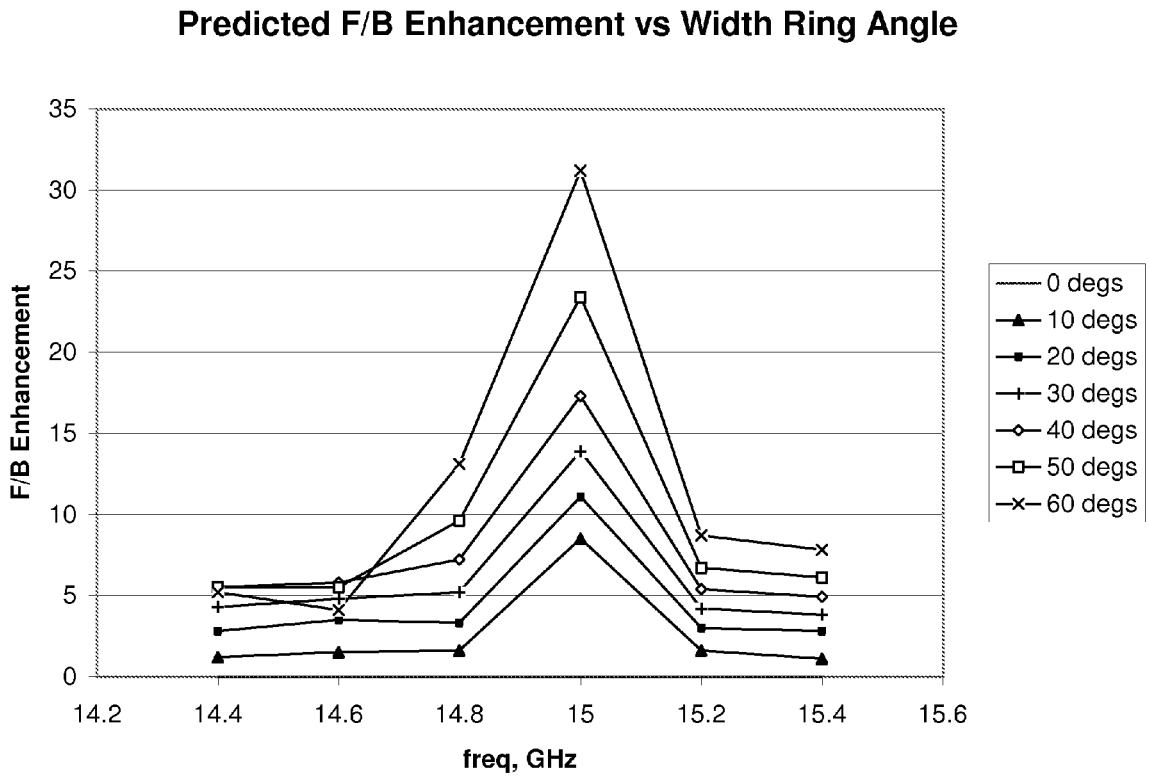
FIG. 19 is a graph comparing predicted F/B enhancement with a band clamp with a width ring configuration of between 0 and 60 degrees radial outward bend.

In a fourth embodiment, the width ring 35 may be provided in an angled configuration as demonstrated in FIG. 18. As shown in FIG. 19, RF modeling software predictions of F/B improvement indicate progressively increasing improvement as the angle applied increases from zero (flat width ring 35 cross section) to sixty degrees of diffraction gradient.

One skilled in the art will appreciate that in addition to improving the electrical performance of the reflector antenna 13, the disclosed band clamp 1 can enable significant manufacturing, delivery, installation and/or maintenance efficiencies. Because the band clamp 1 enables simplified radome 3 and reflector dish 7 periphery geometries, the resulting reflector antenna 13 may have improved materials and manufacturing costs. Because the band clamp 1 is simply and securely attached, installation and maintenance may be simplified compared to prior reflector antenna 13 configurations with complex peripheral geometries, delicate back lobe suppression ring coatings, platings and/or RF absorbing materials. Because the band clamp 1 may be compact and applied close to the reflector antenna aperture H, the overall diameter of the reflector antenna 13 may be reduced, which can reduce the reflector antenna 13 wind loading characteristics and the required packaging dimensions.

| Table of Parts | |
|---|---|
| 1 | band clamp |
| 3 | radome |
| 5 | distal end |
| 7 | reflector dish |
| 9 | subreflector |
| 11 | feed |
| 13 | reflector antenna |
| 15 | distal lip |
| 17 | proximal lip |
| 19 | turnback region |
| 21 | outer surface |
| 23 | signal area |
| 25 | inward end |
| 27 | proximal end |
| 29 | annular lip |
| 31 | outer corner |
| 33 | fold |
| 35 | width ring |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A band clamp for coupling a radome to a distal end of a reflector dish, comprising:

a band with an inward projecting proximal lip and an inward projecting distal lip;

the distal lip dimensioned with an inner diameter less than or equal to a reflector aperture of the reflector dish;

the proximal lip provided with a turnback region dimensioned to engage an outer surface of a signal area of the reflector dish in an interference fit.

2. The band clamp of claim 1, wherein the band clamp has a width between 0.8 and 1.5 wavelengths of an operating frequency.

3. The band clamp of claim 2, wherein a width clamp is coupled to an outer diameter of the band clamp.

4. The band clamp of claim 2, wherein the width clamp has an angle.

5. The band clamp of claim 4, wherein the angle is 60 degrees.

6. The band clamp of claim 1, wherein a ratio of the inner diameter and the reflector aperture is equal to or between 0.97 and 1.

7. The band clamp of claim 1, wherein the band clamp has a width between 0.8 and 1.5 wavelengths of an operating frequency and the proximal lip includes a fold towards the reflector dish.

8. The band clamp of claim 1, wherein the band clamp has a width between 0.8 and 1.5 wavelengths of an operating frequency; and a ratio of the inner diameter and the reflector aperture is equal to or between 0.97 and 1.

9. The band clamp of claim 1, wherein the turnback region is an outward bend of the proximal lip, prior to an inward end of the proximal lip.

10. A reflector antenna, comprising:

a reflector dish;

a radome;

a band clamp coupling the radome to a distal end of the reflector dish;

the band clamp provided with an inward projecting proximal lip and an inward projecting distal lip;

the distal lip dimensioned with an inner diameter less than or equal to a reflector aperture of the reflector dish;

the proximal lip provided with a turnback region dimensioned to engage an outer surface of a signal area of the reflector dish in an interference fit.

11. The reflector antenna of claim 10, wherein the band clamp has a width between 0.8 and 1.5 wavelengths of an operating frequency.

12. The reflector antenna of claim 10, wherein a ratio of the inner diameter and the reflector aperture is equal to or between 0.97 and 1.

13. The reflector antenna of claim 10, wherein the band clamp has a width between 0.8 and 1.5 wavelengths of an operating frequency and the proximal lip includes a fold towards the reflector dish.

14. The reflector antenna of claim 10, wherein the band clamp has a width between 0.8 and 1.5 wavelengths of an operating frequency; and the inner diameter is a ratio of the inner diameter and the reflector aperture equal to or between 0.97 and 1.

15. The reflector antenna of claim 10, wherein the turnback region is an outward bend of the proximal lip, prior to an inward end of the proximal lip.

16. The reflector antenna of claim 10, wherein a width clamp is coupled to an outer diameter of the band clamp.

17. The reflector antenna of claim 16, wherein the width clamp has an angle.

18. The reflector antenna of claim 17, wherein the angle is 60 degrees.

19. A method for reducing a front to back ratio of a reflector antenna with a reflector dish and a radome, comprising the steps of:

forming a band clamp with an inward projecting proximal lip and an inward projecting distal lip;

the distal lip dimensioned with an inner diameter less than or equal to a reflector aperture of the reflector dish;

the proximal lip provided with a turnback region dimensioned to engage an outer surface of a signal area of the reflector dish in an interference fit; and coupling the radome to the reflector dish with the band clamp.

20. The method of claim 19, wherein the band clamp has a width between 0.8 and 1.5 wavelengths of an operating frequency.

* * * * *